US007377451B2

(12) United States Patent
Nomura et al.

(10) Patent No.: US 7,377,451 B2
(45) Date of Patent: May 27, 2008

(54) JET DISPERSING DEVICE

(75) Inventors: Takao Nomura, Toyota (JP); Katsuhiro Ishikawa, Toyota (JP)

(73) Assignee: Trinity Industrial Corporation, Aichi (JP)

( * ) Notice: Subject to any disclaimer, the term of this patent is extended or adjusted under 35 U.S.C. 154(b) by 0 days.

(21) Appl. No.: 10/596,031

(22) PCT Filed: Nov. 25, 2004

(86) PCT No.: PCT/JP2004/017489

§ 371 (c)(1),
(2), (4) Date: Sep. 14, 2006

(87) PCT Pub. No.: WO2005/051550

PCT Pub. Date: Jun. 9, 2005

(65) Prior Publication Data

US 2007/0176018 A1 Aug. 2, 2007

(30) Foreign Application Priority Data

Nov. 26, 2003 (JP) ..... 2003-394961

(51) Int. Cl.

| | |
|---|---|
| ***B05B 15/02*** | (2006.01) |
| ***B05B 1/32*** | (2006.01) |
| ***B05B 1/30*** | (2006.01) |
| ***F23D 14/50*** | (2006.01) |

(52) U.S. Cl. ..... 239/106; 239/104; 239/112; 239/538

(58) Field of Classification Search ..... 239/106–108, 239/104, 112, 583, 113, 119, 398, 407, 408, 239/413, 417.5, 427, 584; 251/63.5, 122; 137/15.04, 15.05, 15.06, 513.5, 513.7
See application file for complete search history.

(56) References Cited

U.S. PATENT DOCUMENTS

| | | | | |
|---|---|---|---|---|
| 5,723,518 | A | 3/1998 | Kahl et al. | |
| 6,652,624 | B2 * | 11/2003 | Ku et al. | 95/19 |
| 6,896,399 | B2 | 5/2005 | Nomura et al. | |
| 2005/0092238 | A1 | 5/2005 | Ueno et al. | |

FOREIGN PATENT DOCUMENTS

| | | |
|---|---|---|
| JP | 7-331170 | 12/1995 |
| JP | 2003-190847 | 7/2003 |

OTHER PUBLICATIONS

English Language Abstract of JP 7-331170.

* cited by examiner

*Primary Examiner*—Darren W Gorman
(74) *Attorney, Agent, or Firm*—Greenblum & Bernstein, P.L.C.

(57) ABSTRACT

A jet dispersing device includes a high pressure region having a flow inlet and a low pressure region having a flow outlet. A partition wall is positioned within the high pressure region such that the high pressure region is partitioned from the low pressure region. Additionally, the partition wall may be provided with at least one nozzle hole configured to jet a liquid from the high pressure region to the low pressure region such that the liquid is dispersed as fine particles. The partitioning wall may also have a cleaning fluid communication port having an opening area which is larger than an opening area of the at least one nozzle. Additionally, a valve mechanism configured to open and close the cleaning fluid communication port may also be provided.

10 Claims, 3 Drawing Sheets

JET DISPERSING DEVICE

TECHNICAL FIELD

The present invention concerns a jet dispersing device suitable to promote mixing of a plurality of fluids such as a two-component mixed type coating material comprising a main ingredient and a curing ingredient by simultaneously jetting and dispersing the same as fine particles.

BACKGROUND ART

Jet dispersing device have been used for in-line mixing less miscible coating material ingredients such as aqueous 2-component polyurethane type coating materials comprising a main agent and a curing agent to each other.

[Patent Document 1] JP-A No. 7-331170

FIG. 4 shows such an existent jet dispersing device 51 in which a partition wall 54 for partitioning a flow inlet 53in and a flow outlet 53out in a tubular housing 52.

The partition wall 54 is formed by extending a bottomed cylindrical tubular member 56 from a central opening to the flow inlet 53in of a flat plate-flange 55, and fine nozzle holes 57 each with a diameter of about 0.5 mm are formed and opposed in the circumferential surface of the tubular wall 56*a*.

FIG. 5 shows a coating material supply system 61 in which the jet dispersing device 51 is disposed in an in-line arrangement. After storing a main agent and a curing agent supplied from a main agent supply source 62A and a curing agent supply source 62B in high pressure cylinders 63A, 63B, when they are supplied under high pressure at a flow rate in accordance with the mixing ratio to the jet dispersing device 51, the main agent and the curing agent merged on the side of the flow inlet 53in of the jet dispersing device 51 are jetted to the down stream upon passage through the nozzle holes 57 toward the flow outlet 53out and they are dispersed as fine particles respectively and mixed under emulsification.

Accordingly, when the mixed coating material is supplied to a coating machine 64, the main agent and the curing agent which are difficult to be mixed can be coated in a state being mixed uniformly.

Then, in the coating material supply system 61 as described above, it is necessary that the coating material flow channel 65 downstream of the meeting place for the main agent and the curing agent has to be cleaned frequently in order to prevent a residual coating material from curing.

However, even when a cleaning fluid such as a cleaning liquid or cleaning air is supplied under pressure from the flow inlet 53in to the flow outlet 53out of the jet dispersing device 51, since fine nozzle holes 57 formed in the partition wall 54 gives a flow channel resistance to lower the flow speed of the cleaning fluid, it requires a long time for cleaning and increase the amount of the cleaning liquid and the cleaning air, to bring about a problem that efficient cleaning is impossible.

While it has been attempted to increase the pressure of supplying the cleaning liquid and the cleaning air to thereby shorten the cleaning time, this not only requires a high pressure pump for supplying the cleaning liquid and the cleaning air but also complicates the facility such as by the use of hoses and connectors acceptable for pressure proofness and, on the other hand, the cleaning time can not be shortened by so much.

DISCLOSURE OF THE INVENTION

Subject to be Solved by the Invention

In view of the above, it is a technical subject of the present invention to adapt such that a cleaning fluid can be caused to flow at a flow speed to some extent in a flow channel of a jet dispersing device formed with fine nozzle holes for jetting and dispersing a liquid even in a case where the dispersing device is disposed in an in-line arrangement thereby capable of cleaning the flow channel efficiently, rapidly, and reliably.

Means for the Solution of the Subject

For solving the subject, the present invention provides a jet dispersing device in which a partition wall for partitioning a high pressure region having a flow inlet and a low pressure region having a flow outlet is formed with nozzle holes for jetting a liquid from the high pressure region to the low pressure region and dispersing the same as fine particles characterized in that a cleaning fluid communication port of a larger opening area compared with the that of the nozzle hole is formed in the partition wall, and a valve mechanism for opening and closing the communication port is provided.

Effect of the Invention

In the jet dispersing device according to the invention, when a cleaning fluid is supplied by opening the cleaning fluid communication port formed in the partition wall by the valve mechanism, since the cleaning fluid flowing from the high pressure region to the low pressure region flows passing through the cleaning fluid communication port of the large opening area compared with that of the nozzle hole, the cleaning fluid does not undergo the resistance given by the nozzle holes, can be caused to flow at a flow rate necessary for cleaning, and can rapidly and reliably clean the jet dispersing device and the flow channel in which the sprayer is disposed in the in-line arrangement.

Best Mode for Practicing the Invention

The present invention has attained the subject capable of cleaning the jet dispersing device and the flow channel in which the sprayer is disposed in the in-line arrangement rapidly and reliably by adapting such that a cleaning fluid can be caused to flow in the flow channel at a necessary flow speed.

EXAMPLE 1

The present invention is to be described by way of embodiments shown in the drawings.

FIG. 1 is an explanatory view showing an example of a jet dispersing device according to the invention, FIG. 2 is an explanatory view showing a case of incorporation into a coating material supply system in an in-line arrangement, and FIG. 3 is an explanatory view showing another embodiment.

In a jet dispersing device 1 shown in FIG. 1, the inside of a housing H is partitioned into a high pressure region 3H formed with a flow inlet 2in and a low pressure region 3L formed with a flow outlet 2out by a partition wall 4.

The partition wall 4 is formed with nozzle holes 5 for jetting a liquid from the high pressure region 3H to the low pressure region 3L and dispersing the same as fine particles, and formed with a cleaning fluid communication port 6 having a larger opening area compared with that of the nozzle holes 5, and a valve mechanism V for opening and closing the cleaning fluid communication port 6 is formed integrally with the housing H.

The partition wall 4 has a tubular member 8 extended from the bottom 7 to the high pressure region 3H of the housing H and is formed with fine nozzle holes 5 of about 0.5 mm in diameter being opposed to each other in a tubular wall 9 of the tubular member 8, and the end on the high pressure region is opened as the cleaning fluid communication port 6.

The cleaning fluid communication port 6 is formed at an opening area equal with that of the flow inlet 2in and flow outlet 2out such that no high pressure loss is caused between the high pressure region 3H and the low pressure region 3L even when a liquid at high pressure flows in the jet dispersing device 1 and, accordingly, the liquid can be caused to flow at a predetermined flow rate necessary for cleaning even when the cleaning fluid is supplied at a low pressure.

The valve mechanism V has a rod, as a valve body 10 which is inserted into and withdrawn from the tubular member 8 from the cleaning fluid communication port 6, and the valve body 10 is adapted to advance and retract by an optional driving mechanism 11 formed integral with the housing H.

Thus, the cleaning fluid communication port 6 is opened in a state of where the top end of the valve body 10 is withdrawn from the tubular member 8 and is closed in a state where it is inserted into the tubular member 8.

Further, so that leakage from the high pressure region to the low pressure region can be prevented with no provision of a seal such as an O ring in the gap when the valve body 10 is inserted into the tubular member 8 to close the cleaning fluid communication port 6, the clearance therebetween is selected as from 0 to 50 μm, preferably, 10 to 15 μm.

Further, a valve seat 12 clogged by the top end of the valve body 10 is formed in the low pressure region 3L of the tubular member 8 and, when the valve body 10 is inserted as far as the valve seat 12, since both of the nozzle holes 5 and the cleaning fluid communication port 6 are closed, this can be used also as an on-off valve for conducting/shutting an optimal flow channel when it is installed in an in-line arrangement in the flow channel.

An example of the constitution of the invention is as has been described above and the operation thereof is to be described to a case of applying the jet dispersing device 1 to a coating material supply system 21 of an aqueous two-component mixed type coating material as an example.

A coating material supply system 21 has metering cylinders 23A, 23B for supplying a main agent and a curing agent simultaneously each at a flow rate in accordance with the mixing ratio and a pumping cylinder 24 for storing the main agent and the curing agent supplied simultaneously and delivering them at high pressure to a coating machine 22, in which a jet dispersing device 1 is interposed in a flow channel 25 from the pumping cylinder 24 to the coalting machine 22.

Valve devices 27A, 27B for supplying a cleaning fluid are interposed in the flow channels 26A, 26B extending from the metering cylinders 23A, 23B to the pumping cylinder 24.

In a case of supplying the main agent and the curing agent to the coating machine 22, the main agent and the curing agent are supplied simultaneously each at a flow rate in accordance with the mixing ratio from the metering cylinders 23A, 23B, while shutting the flow channel 25 by advancing the valve body 10 of the jet dispersing device 1 to close the valve seat 12, the main agent and the curing agent are mixed at the meeting place for the flow channels 26A and 26B and they are stored in the pumping cylinder 24 with no leakage to the flow channel 25 as shown in FIG. 1(*a*).

In this stage, while the main agent and the curing agent are mixed each in an amount corresponding to the mixing ratio, individual droplets are large in the size with low uniformness.

Then, as shown in FIG. 1 (*b*), when the valve body 10 of the jet dispersing device 1 is retracted by opening only the nozzle holes 5 while closing the cleaning fluid communication port 6, and the coating material is supplied from the pumping cylinder 24 at a high pressure of about 50 kg/cm-.sup.2 (4.5 MPa), the main agent and the curing agent are jetted from the high pressure region 3H to the low pressure region 3L upon passage through the nozzle holes 5 and dispersed in finely particles and, as a result, they are supplied in a uniformly mixed state to the coating machine 22.

Further, upon cleaning, the valve body 10 is retracted till the top end is completely withdrawn from the tubular member 8 to open the cleaning fluid communication port 6 as shown in FIG. 1(*c*).

Then, when the cleaning fluid is supplied from each of the valve devices 27A, 27B, the cleaning fluid after cleaning the inside of the pumping cylinder 24 reaches the jet dispersing device 1 while cleaning the flow channel 25.

Since the cleaning fluid flowing from the flow inlet 2in into the high pressure region 3H of the jet dispersing device 1 is discharged by way of a cleaning fluid communication port 6 having a larger opening area compared with that of the nozzle hole 5, it can provide a merit that the cleaning liquid flows at a constant flow rate necessary for cleaning the inside of the flow channel 25 even when the cleaning fluid is supplied at a low pressure, and capable of cleaning the jet dispersing device 1 and the flow channel 25 in a short period of time.

Then, finally, when the valve body 10 is advanced again while supplying the cleaning fluid as it is, as shown in FIG. 1(*b*), to clog the cleaning fluid communication 6 and also open the nozzle holes 5, even when the nozzle holes 5 of a small diameter are clogged with the coating material, the coating material can be finely cleaned and removed.

FIG. 3 shows another embodiment of a jet dispersing device according to the invention. Portions in common with those in FIG. 1 carry the same reference numerals, for which detailed descriptions will be omitted.

In the jet dispersing device 31 of this embodiment, an end of a high pressure region of a tubular member 8 extended to the high pressure region 3H is opened and formed as a cleaning fluid communication port 6, and the valve mechanism V closing the cleaning fluid communication port 6 has a valve body 10 inserted to and detached from the inside of the tubular member 8 from the communication port 6. A predetermined clearance is formed for the gap between the valve body 10 to be inserted into the tubular member 8 and the tubular member 8 such that the gap forms a nozzle hole 5 for jetting the coating material mixture of the main agent and the curing agent from the high pressure region to the low pressure region and dispersing the same as fine particles.

With such a constitution, since the cleaning fluid communication port 6 is opened in a state of withdrawing the top end of the valve body 10 from the tubular member 8 and, when the valve body 10 is inserted as far as the valve seat 12 formed on the low pressure region 3L of the tubular member 8, since the nozzle hole 5 and the cleaning fluid communication port 6 are closed, when the device is disposed in an optional flow channel in an in-line arrangement, this can be used also as an on-off valve for conducting/shutting the flow channel.

Further, in the low pressure region 3L of the tubular member 8, a valve seat 12 to be closed by the top end of the valve body 10 is formed, by which the cleaning fluid communication port 6 is opened in a state of withdrawing the top end of the valve body 10 from the tubular member 8 and closed in a state of inserting it into the tubular member 8.

Further, when the valve body 10 is inserted as far as the valve seat 12, since both of the nozzle hole 5 and the cleaning fluid communication port 6 are closed, in a case of providing the same in an optional flow channel in an in-line arrangement, this can be utilized also as an on/off valve for conducting/shutting the flow channel.

Then, when the jet dispersing device 31 is disposed instead of the jet dispersing device 1 in the coating material supply system 21 shown in FIG. 2, the main agent and the curing agent can be supplied under mixing in the same manner as described above.

When the main agent and the curing agent are supplied to the coating machine 22, the valve body 10 of the jet dispersing device 1 is advanced to close the valve seat 12 as shown in FIG. 3(*a*).

Thus, the main agent and the curing agent supplied from the metering cylinders 23A, 23B are stored in the pumping cylinder 24 with no leakage to the flow channel 25.

Then, as shown in FIG. 3(*b*), when the valve body 10 of the jet dispersing device 1 is retracted and stopped at a position where the top end thereof is slightly inserted into the cleaning fluid communication port 6, since a ring-shaped nozzle hole 5 having a predetermined clearance is formed, when a coating material is supplied from the pumping cylinder 24 at a high pressure of about 50 kg/cm.sup.2 (4.5 MPa), the main agent and the curing agent is jetted from the high pressure region 3H to the low pressure region 3L upon passage through the nozzle hole 5 and dispersed as fine particles and, as a result, they are supplied in a uniformly mixed state to the coating machine 22.

Upon cleaning, when the valve body 10 is retracted till the top end is completely withdrawn from the tubular member 8 as shown in FIG. 3(*c*), a cleaning fluid communication port 6 of a large opening area is opened.

Since the cleaning fluid supplied from each of the valve devices 27A, 27B reaches the jet dispersing device 1 while cleaning the pumping cylinder 24 and the flow channel 25 and upon entering into the high pressure region 3H from the flow inlet 2in to the jet dispersing device 1, passes through the cleaning fluid communication port 6 of a larger opening area compared with that of the nozzle hole 5 and discharges to the low pressure region 3L, the cleaning fluid flows at a predetermined flow speed necessary for cleaning the inside of the flow channel 25 even when the cleaning fluid is supplied at a low pressure, to provide a merit capable of cleaning the jet dispersing device 21 and the flow channel 25 in a short time.

In this case, since the gap forming the nozzle hole is enlarged to form a cleaning fluid communication port 6, the coating material clogged in the nozzle hole is also cleaned and removed simultaneously by supplying the cleaning fluid.

In the foregoings while the description has been made to a case of use for the coating material supply system 21 of the aqueous two-component mixed type coating material, the invention is not restricted only thereto but can be used for liquid supply systems for optional coating materials paints, and like.

INDUSTRIAL APPLICABILITY

Since the cleaning fluid communication port of a larger opening area compared with that of the nozzle hole can be opened, even when the cleaning fluid is supplied at a low pressure during cleaning, it can be caused to flow at a predetermined flow rate necessary for cleaning and it is suitable in a case of disposing the same in the fluid flow channel in the in-line arrangement, to the application use of reliably cleaning fluid deposited in the flow channel and the jet dispersing device in a short period of time.

Figure 1A:
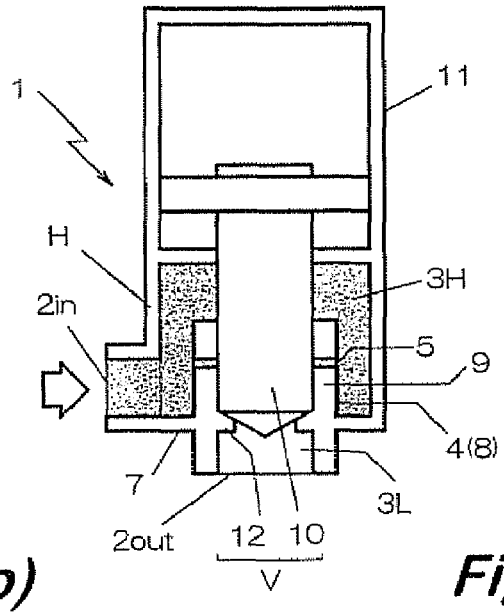
FIG. 1 is an explanatory view showing an example of a jet dispersing device according to the invention.
Figure 1B:
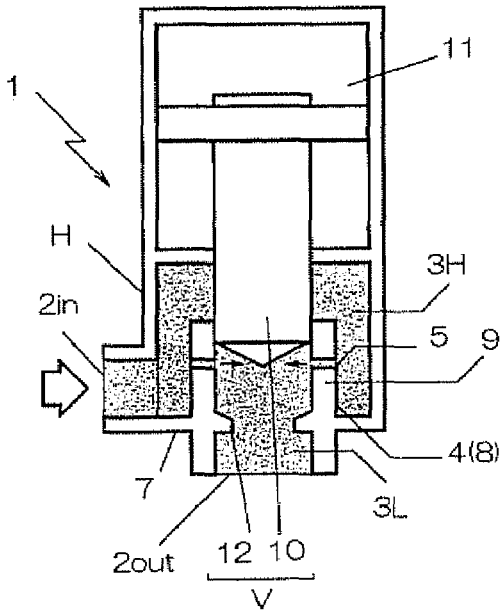
Figure 1C:
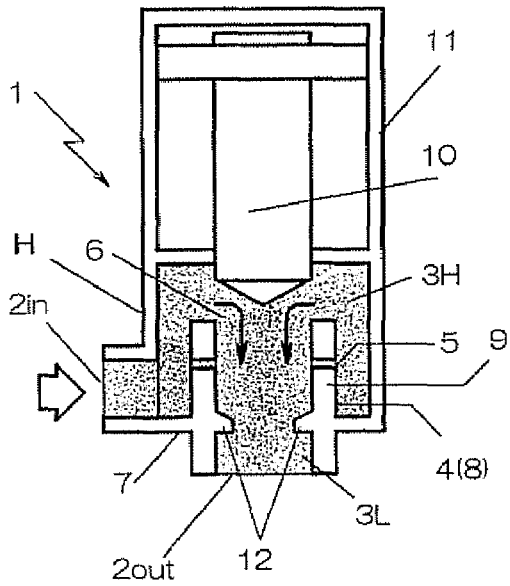
Figure 2:
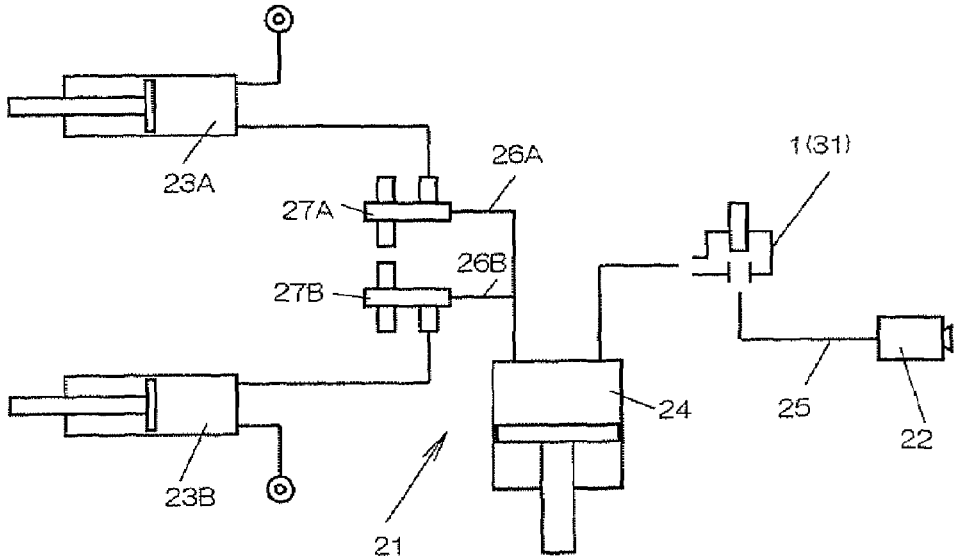
FIG. 2 is an explanatory view showing a coating material supply system incorporated with a jet dispersing device.
Figure 3A:
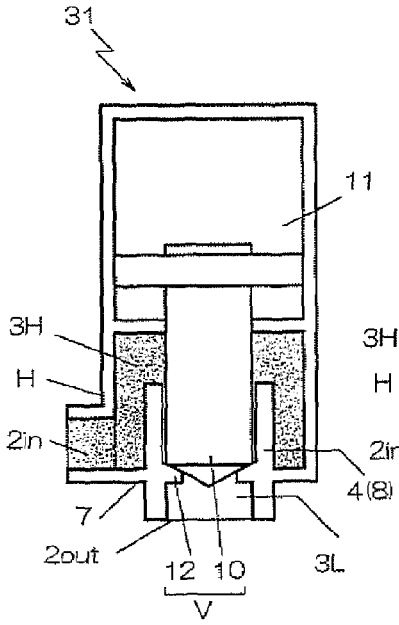
FIG. 3 is an explanatory view showing an example of another jet dispersing device according to the invention.
Figure 3B:
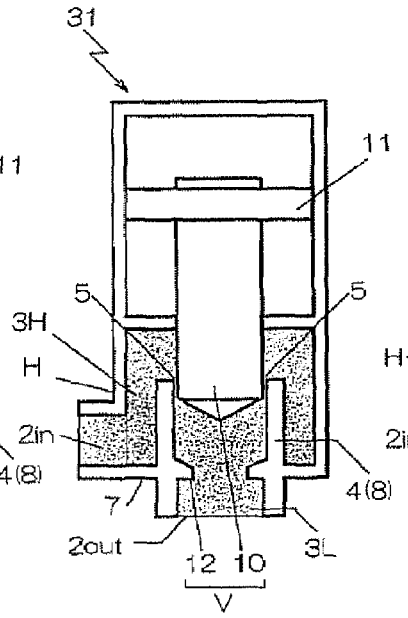
Figure 3C:
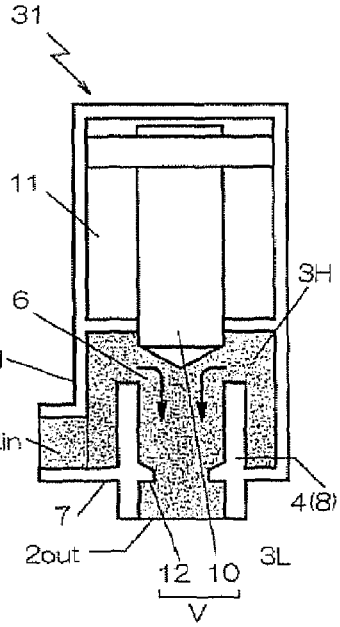
Figure 4:
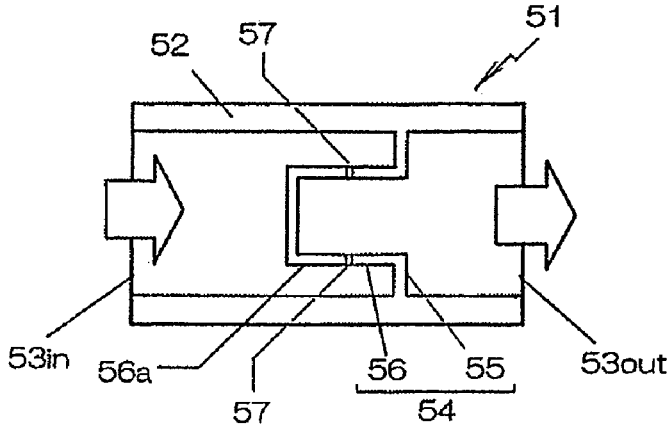
Fig. 4 PRIOR ART
FIG. 4 is an explanatory view showing an existent jet dispersing device.
Figure 5:
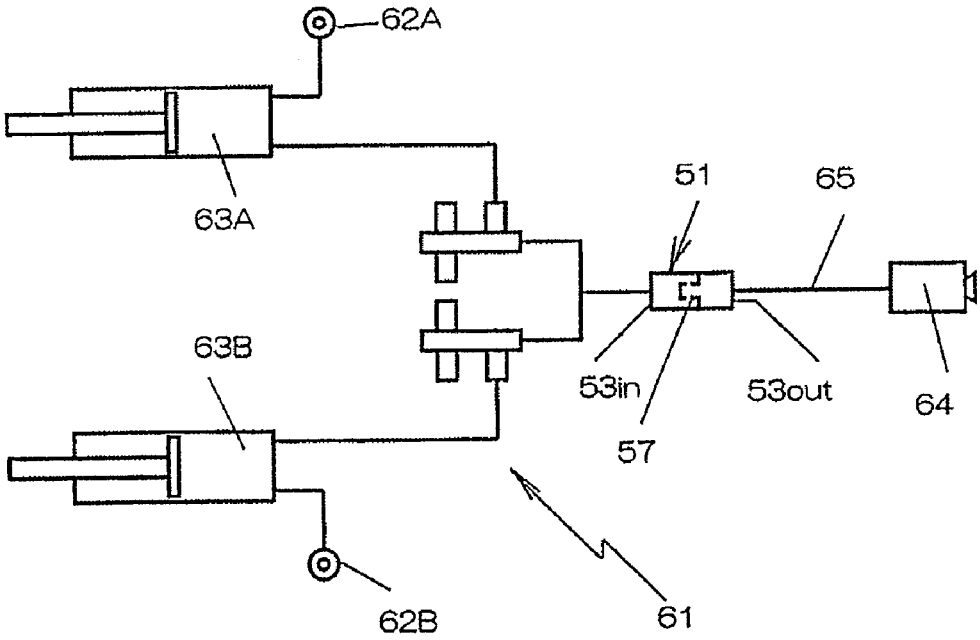
Fig. 5 PRIOR ART
FIG. 5 is an explanatory view showing a coating material supply system to which an existent device is incorporated.

DESCRIPTION OF REFERENCES l, 31 jet sprayer
H housing
2in flow inlet
2out flow outlet
3H high pressure region
3L low pressure region
4 partition wall
5 nozzle hole
6 Cleaning fluid communication port
V valve mechanism
7 flange portion
9 tubular member
10 valve body
12 valve seat

What is claimed is:

1. A jet dispersing device, comprising:

a high pressure region having a flow inlet;

a low pressure region having a flow outlet;

a partition wall positioned within the high pressure region such that the high pressure region is partitioned from the low pressure region, wherein the partition wall has at least one nozzle hole configured to jet a liquid from the high pressure region to the low pressure region such that the liquid is dispersed as fine particles, and wherein the partition wall has a cleaning fluid communication port having an opening area which is larger than an opening area of the at least one nozzle hole; and a valve mechanism configured to open and close the cleaning fluid communication port.

2. The jet dispersing device according to claim 1, wherein the partition wall comprises a tubular member extending within the high pressure region and the at least one nozzle hole is provided on the tubular member of the partition wall, wherein an end of the partition wall is provided with the cleaning fluid communication port, and wherein the valve mechanism comprises a valve body which opens and closes the cleaning fluid communication port.

3. The jet dispersing device according to claim 2, wherein the valve body comprises a rod which is configured to be inserted within and withdrawn from an inside of the tubular member thereby closing and opening the cleaning fluid communication port, respectively.

4. The jet dispersing device according to claim 3, wherein a clearance, defined by a spacing between the valve body and the tubular member, is in a range of 0 μm to 50 μm.

5. The jet dispersing device according to claim 4, further comprising a valve seat provided within the tubular member, wherein the valve body is configured to engage the valve seat such that the at least one nozzle hole is closed.

6. The jet dispersing device according to claim 3, wherein a clearance, defined by a spacing between the valve body and the tubular member, is from 0 μm to 15 μm.

7. The jet dispersing device according to claim 6, further comprising a valve seat provided within the tubular member, wherein the valve body is configured to engage the valve seat such that the at least one nozzle hole is closed.

8. The jet dispersing device according to claim 3, further comprising a valve seat provided within the tubular member, wherein the valve body is configured to engage the valve seat such that the at least one nozzle hole is closed.

9. The jet dispersing device according to claim 1, wherein the partition wall comprises a tubular member extending within the high pressure region, wherein an end of the partition wall is provided with the cleaning fluid communication port, the valve mechanism comprises a valve body which opens and closes the cleaning fluid communication port, and a gap defined by a spacing between the valve body and the tubular member forms one of the at least one nozzle hole.

10. The jet dispersing device according to claim 9, further comprising a valve seat provided within the tubular member, wherein the valve body is configured to engage the valve seat such that the at least one nozzle hole is closed.

* * * * *